US009321586B2

(12) United States Patent
Langh

(10) Patent No.: US 9,321,586 B2
(45) Date of Patent: Apr. 26, 2016

(54) CONTAINER-LIKE CARGO TRANSPORT UNIT FOR TRANSPORTING CYLINDRICAL CARGO, SUCH AS REELS

(71) Applicant: Hans Langh, Piikkio (FI)

(72) Inventor: Hans Langh, Piikkio (FI)

(73) Assignee: OY LANGH SHIP AB, Piikkio (FI)

( * ) Notice: Subject to any disclaimer, the term of this patent is extended or adjusted under 35 U.S.C. 154(b) by 0 days.

(21) Appl. No.: 14/537,451

(22) Filed: Nov. 10, 2014

(65) Prior Publication Data

US 2015/0129448 A1 May 14, 2015

(30) Foreign Application Priority Data

Nov. 11, 2013 (FI) ..... 20136103

(51) Int. Cl.
*B65D 88/12* (2006.01)
*B65D 85/66* (2006.01)
(Continued)

(52) U.S. Cl.
CPC ..... *B65D 88/12* (2013.01); *B65D 85/66* (2013.01); *B65D 90/006* (2013.01); *B65D 90/0053* (2013.01); *B65D 90/12* (2013.01); *B65D 2590/0058* (2013.01)

(58) Field of Classification Search
CPC ..... B65D 85/66; B65D 88/12; B65D 88/121; B65D 88/14; B65D 90/0053; B65D 90/006; B65D 90/12; B65D 2590/0058; B60K 15/03; B60K 15/03177; B60P 3/077; B60P 7/08; B60P 7/0823; B60P 7/0876; B60P 7/10; B60P 7/12; B60P 7/15; B60P 45/006
USPC ..... 220/1.5, 562; 206/446; 410/30, 32, 410/34–36, 42, 47–50, 89, 96–97, 143–144, 410/150; 105/355; 248/351, 354.1
See application file for complete search history.

(56) References Cited

U.S. PATENT DOCUMENTS 4,966,310 A 10/1990 Hawkins
5,211,518 A * 5/1993 Mimica ..... 410/50
(Continued)

FOREIGN PATENT DOCUMENTS

CA 2708425 A1 12/2011
DE 1934336 A1 1/1971
(Continued)

OTHER PUBLICATIONS

Finnish Search Report, dated Jun. 10, 2014, from corresponding FI application.
(Continued)

*Primary Examiner* — Bryon Gehman
*Assistant Examiner* — Brijesh V. Patel
(74) *Attorney, Agent, or Firm* — Young & Thompson

(57) ABSTRACT

A cargo transport unit for transporting cylindrical cargo includes a first side and an opposite, second side, a first end and an opposite, second end, a trough including inclined support walls supporting the cylindrical cargo, and a frame structure supporting the trough from below and including plural transverse supports. A first longitudinal edge profile and a second longitudinal edge profile of its bottom structure are both made of a profile including a continuous seamless structure extending from a first end to a second end of the cargo transport unit, and the transverse supports include a lower part extending from the first to the second longitudinal edge profile, and located at a height level of the longitudinal edge profiles, the lower part at its first end being welded to the first longitudinal edge profile and at its opposite, second end being welded to the second longitudinal edge profile.

15 Claims, 3 Drawing Sheets

(51) Int. Cl.
*B65D 90/00* (2006.01)
*B65D 90/12* (2006.01)

(56) References Cited

U.S. PATENT DOCUMENTS 5,267,648 A * 12/1993 Baker ..... 206/446
5,413,054 A * 5/1995 Collins ..... 108/55.3
5,558,218 A * 9/1996 James et al. ..... 206/303
6,231,284 B1 5/2001 Kordel
7,891,504 B2 * 2/2011 DeMent ..... 211/59.4
7,997,441 B2 * 8/2011 Marcel ..... 220/647
8,297,459 B2 * 10/2012 Romanus et al. ..... 220/1.5
8,366,361 B1 * 2/2013 Landrum ..... 410/49
2007/0012588 A1 * 1/2007 Smolenski et al. ..... 206/386
2008/0135546 A1 * 6/2008 Smith et al. ..... 220/1.5
2010/0329809 A1 * 12/2010 Langh ..... 410/96
2012/0000906 A1 1/2012 Langh
2014/0027321 A1 * 1/2014 Langh-Lagerlof ..... 206/216

FOREIGN PATENT DOCUMENTS

FI 121372 B 10/2010
WO 2010142854 A1 12/2010

OTHER PUBLICATIONS

EP Search Report, for Corresponding Patent Application.

* cited by examiner

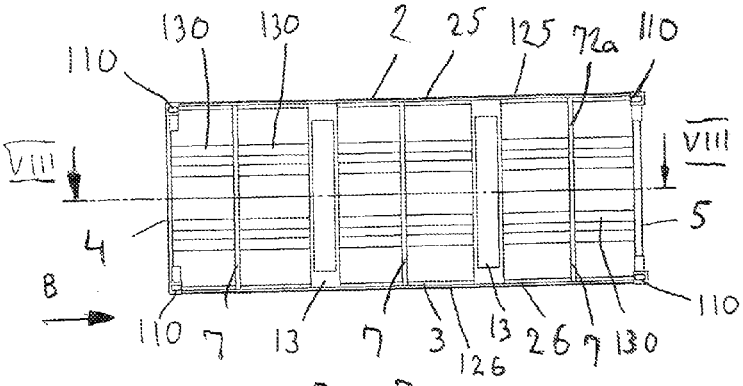
Fig. 7
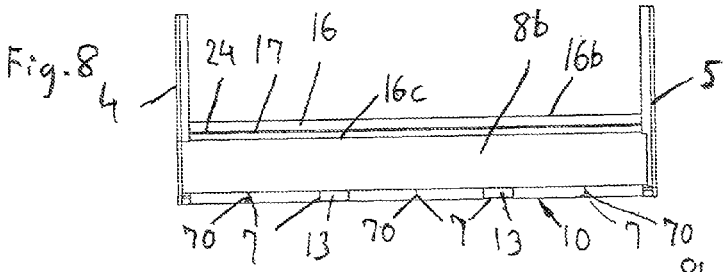
Fig. 8
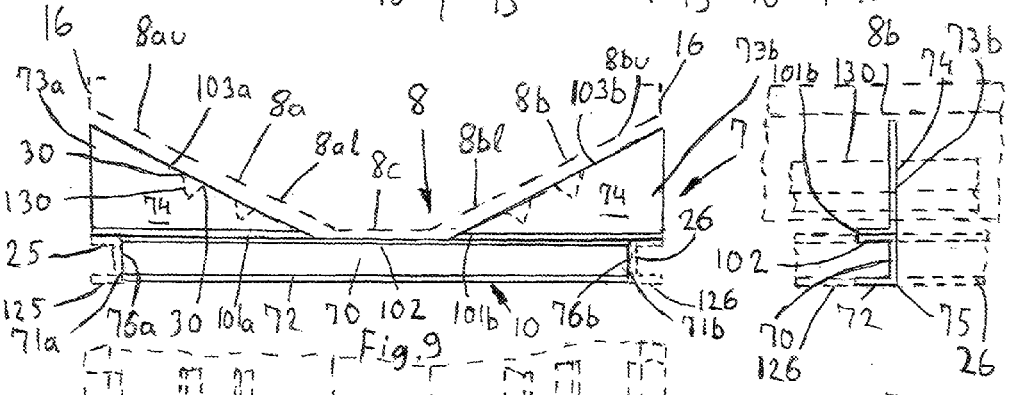
Fig. 9
Fig. 10
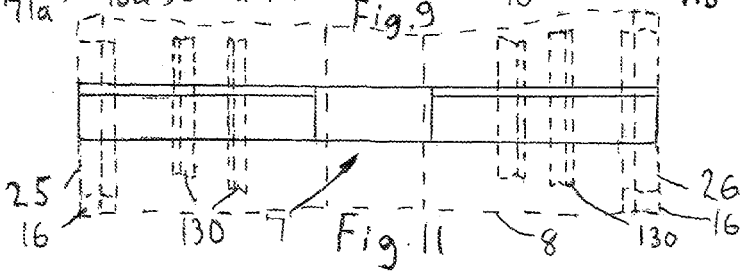
Fig. 11

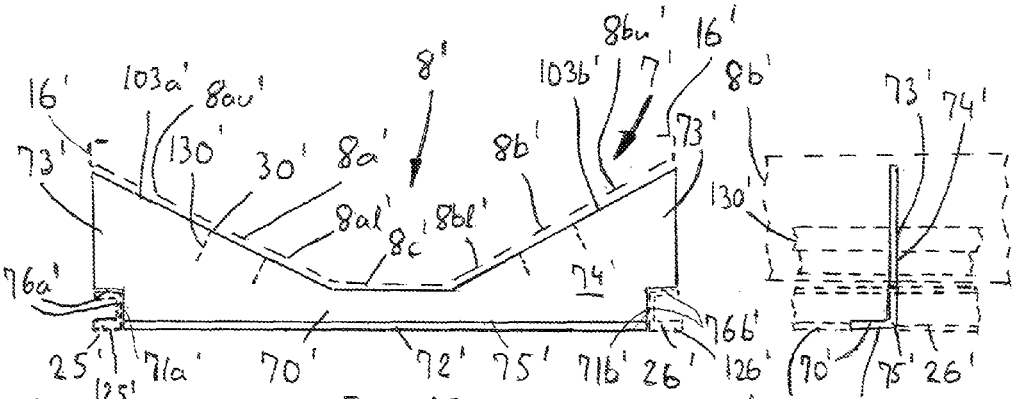
Fig. 12
Fig. 13
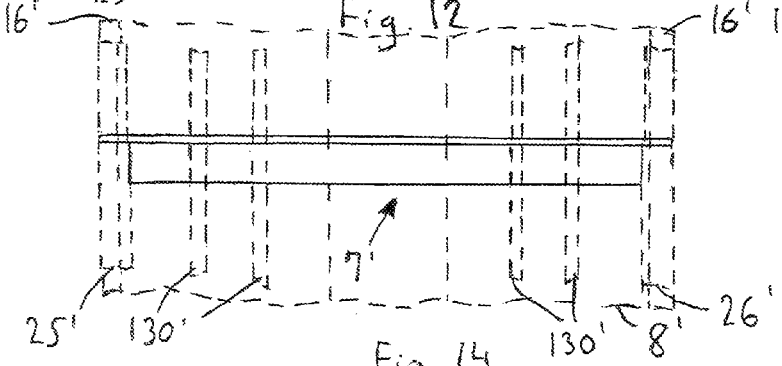
Fig. 14
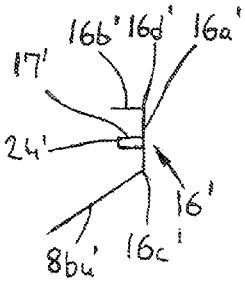
Fig. 15

CONTAINER-LIKE CARGO TRANSPORT UNIT FOR TRANSPORTING CYLINDRICAL CARGO, SUCH AS REELS

BACKGROUND OF THE INVENTION

The invention relates to a container-like cargo transport unit for transporting cylindrical cargo, such as reels.

A cargo transport unit of the above type is known e.g. from document WO2010/142854A1. It is difficult and time-consuming to manufacture this known cargo transport unit comprising a trough, as well as other such known cargo transport units, since they comprise a plurality of large longitudinal diagonal supports which are cumbersome to handle. These supports are made of sheet material and arranged between the transverse supports to support the trough from below and edged at their lower ends so as to form the longitudinal edge profiles of the cargo transport unit. The manufacture of the known cargo transport units provided with a trough requires edge-cutting and welding of numerous components as well as accurate matching of the components in order to make the dimensions and strength of the cargo transport units as desired.

BRIEF DESCRIPTION OF THE INVENTION

An object of the invention is to provide a container-like cargo transport unit whose frame structure in particular is easy and quick to manufacture to be extremely strong so as to enable the cargo transport unit to be loaded with heavy cargo, such as a plurality of heavy steel reels whose weight is 20 t each, for instance.

In order to implement this, the invention provides a container-like cargo transport unit for transporting cylindrical cargo, such as reels, the cargo transport unit comprising a first side extending in a longitudinal direction of the cargo transport unit and a second side opposite the first side, a first end transverse to the longitudinal direction of the cargo transport unit and a second end opposite the first end, a trough in the longitudinal direction of the cargo transport unit and comprising inclined support walls for supporting the cylindrical cargo on inclined upper surfaces thereof, a frame structure supporting the trough from below and comprising a plurality of transverse supports supporting the inclined support walls of the trough from below and spaced apart from one another in the longitudinal direction of the cargo transport unit, inclined upper edges of the transverse supports being shaped to conform with the inclined support walls of the trough for supporting the inclined support walls over at least a vast majority of their length in a transverse direction of the cargo transport unit, and a bottom structure comprising a first longitudinal edge profile extending in the longitudinal direction of the cargo transport unit and a second longitudinal edge profile positioned oppositely to the first longitudinal edge profile, wherein the first longitudinal edge profile and the second longitudinal edge profile are both made of a profile comprising a continuous seamless structure extending from the first end of the cargo transport unit to the second end thereof, and the transverse supports comprise a lower part extending from the first longitudinal edge profile to the second longitudinal edge profile and residing at a height level of the longitudinal edge profiles, the lower part at its first end being welded to the first longitudinal edge profile and at its opposite, second end being welded to the second longitudinal edge profile. A continuous seamless structure herein refers to a structure provided with no weld seams nor other fastening arrangements, such as bolts, either for achieving the necessary strength of the structure and the required length of the longitudinal edge profile. Said seamless structure can e.g. be a U profile (U beam) or only a side of a U profile extending along the whole length of the cargo transport unit.

A starting point for and, at the same time, the idea underlying the cargo transport unit according to the invention is—with the purpose of making the cargo transport unit easier to manufacture—to dismiss the conventionally used plurality of longitudinal diagonal supports extending from end to end of the cargo transport unit and supporting the trough from below, said diagonal supports being arranged between the transverse supports and extending from the lower surface of the trough to the lower edges of the cargo transport unit, the diagonal supports further being edged at their lower edge so as to form the longitudinal edge profiles included in the bottom structure of the cargo transport unit, and to replace these longitudinal diagonal supports with novel transverse supports and longitudinal edge profiles.

Preferred embodiments of the cargo transport unit according to the invention are disclosed in the accompanying dependent claims.

One of the greatest advantages of the cargo transport unit according to the invention is that its frame structure in particular is easy and quick to manufacture to be strong and dimensionally accurate, thus further enabling the manufacture to be implemented as serial production.

BRIEF DESCRIPTION OF THE FIGURES

The invention is now described in closer detail by means of a preferred embodiment and with reference to the accompanying drawing, in which FIG. 7 shows the cargo transport unit of FIG. 1 when viewed from below, FIG. 8 shows a view along section VIII-VIII of FIG. 7, FIGS. 9 to 11 are front (when viewed in a direction of arrow B in FIG. 7), side, and top views, respectively, of a transverse support included in a frame structure of the cargo transport unit, FIGS. 12 to 14 illustrate a second embodiment of the cargo transport unit by showing front, side, and top views, respectively, of a transverse support included in the frame structure thereof, with angle of views corresponding to those shown in FIGS. 9 to 11, and FIG. 15 relates to the embodiment of the cargo transport unit illustrated by FIGS. 12 to 14, showing a structure corresponding to that shown in FIG. 6.

DETAILED DESCRIPTION OF THE INVENTION

Figure 2:
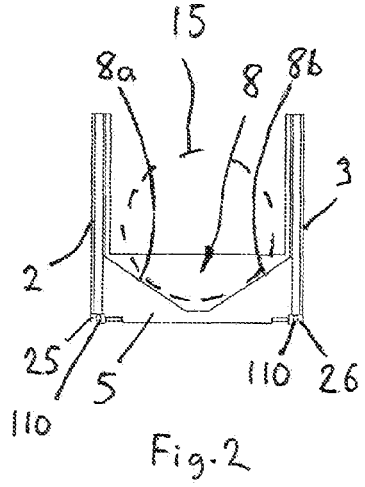
FIG. 2 shows the cargo transport unit of FIG. 1 when viewed in a direction of arrow A in FIG. 1.
Figure 1:
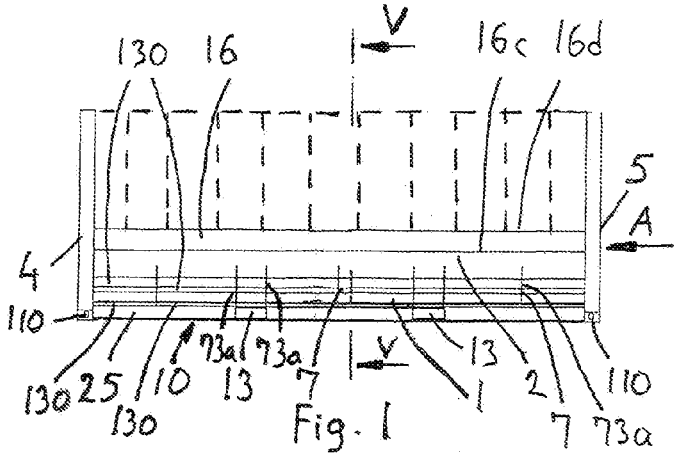
FIG. 1 shows a general view of a cargo transport unit according to the invention.

FIGS. 1 and 2 are side and end views (when viewed in the direction of arrow A in FIG. 1), respectively, of a cargo transport unit according to the invention in the form of a container. The container comprises a frame structure denoted generally by reference number 1, opposite sides 2, 3 (a first side 2 and a second side 3, respectively), which are side walls of the container, and a first end 4 and a second end 5 oppositely positioned with respect to the first end. The side wall of the container is illustrated in broken line. The frame structure 1 supports a trough 8 of the container from below. The trough 8, provided for supporting cylindrical cargo 15 to be transported, such as reels, comprises inclined support walls 8*a*, 8*b*, cf. FIG. 2. Upper surfaces of the inclined support walls 8*a*, 8*b* of the trough 8 form support surfaces for supporting cylindrical cargo 15. A plurality of transverse supports 7 is arranged beneath the support walls 8*a*, 8*b*, spaced apart from one another in the longitudinal direction of the container, cf. FIG. 1. The number of transverse supports 7 is typically four to seven, depending on the length of the container. In the embodiment of FIGS. 1 to 8, the number of transverse supports 7 is five. The transverse supports are made of sheet material. The transverse supports 7 comprise inclined upper edges shaped to conform with the inclined support walls 8*a*, 8*b* of the trough, cf. FIG. 9, wherein the inclined upper edges of the transverse supports are designated by reference numbers 103*a* and 103*b* and the trough is drawn in broken line. The upper edges 103*a*, 103*b* of the transverse supports are welded to a lower surface of the support walls 8*a*, 8*b* of the trough 8.

Figure 5:
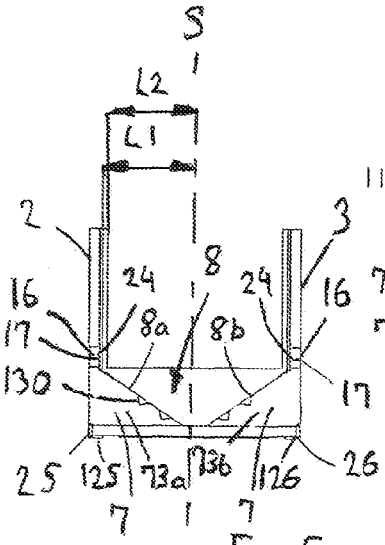
FIG. 5 shows a view along section V-V of FIG. 1.

The frame structure 1 preferably also includes longitudinal supports 130 arranged underneath the inclined support walls 8*a*, 8*b* of the trough and welded to the lower surface of the support walls 8*a*, 8*b* and provided in the longitudinal direction of the container. The longitudinal supports 130 can be clearly seen in FIG. 3, which illustrates the container with no side walls so as to show the frame structure of the container better; FIGS. 1, 2, and 5 only show some of the longitudinal supports 130. FIG. 5 illustrates the longitudinal supports 130 as seen in the longitudinal direction of the container. The longitudinal supports 130 are arranged between the transverse supports 7, and they extend from a first end of the trough 8 to an opposite end thereof. In the embodiment shown in the figures, the longitudinal support 130 extending from one end of the container to the other end thereof is a multi-element piece consisting of eight aligned longitudinal parts. The purpose of the longitudinal supports 130 is to prevent the support walls 8*a*, 8*b* of the trough 8 from buckling. The cross section of the longitudinal supports 130 follows the shape of V. The shape of the cross section of the supports 130 bears no essential significance. Thus, alternatively, the cross section of the longitudinal supports 130 may follow the shape of U, I or H, for instance. It is to be noted in this connection that in the embodiment of FIG. 12, the longitudinal supports 130' are straight planar plate pieces whose plane is substantially perpendicular to the support walls 8*a*', 8*b*' of the trough and which are welded 30' to the lower surface of the inclined support walls 8*a*', 8*b*' of the trough. Also in the embodiment of FIGS. 1 to 11, such plate pieces may serve as the longitudinal supports.

Figure 3:
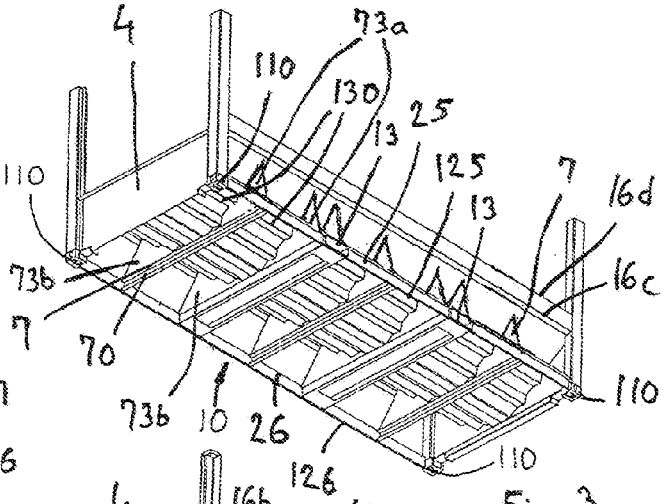
FIG. 3 is an axonometric view illustrating a bottom structure of the cargo transport unit of FIG. 1 when viewed obliquely from below.

A bottom structure 10 of the container comprises longitudinal edge profiles 25, 26 extending from one end 4 of the container to the other end 5 thereof (a first edge profile 25 and a second edge profile 26, respectively), best shown by FIGS. 3 and 9. FIG. 1 only shows the first longitudinal edge profile 25, but FIG. 3 also shows the second longitudinal edge profile 26 located oppositely to the first longitudinal edge profile 25. The edge profiles 25, 26 are formed of a continuous seamless profile whose cross section follows the shape of U. Thus, the edge profiles 25, 26 extend from end 4 to end 5 of the container as a uniform (continuous) seamless structure. The edge profiles 25, 26 open up outwards from the sides 2, 3 of the container. Alternatively, the edge profiles 25, 26 may e.g. have a rectangular cross section. The edge profiles 25, 26 are generally available profiles consisting of one element and provided with no transverse weld seams. The sides 2, 3 of the container are provided with fork pockets 13 to enable the container to be lifted by a fork-lift truck (not shown). The fork pockets 13 are formed from profiles residing transversely to the edge profiles 25, 26 and welded to openings in the edge profiles 25, 26 for the fork pockets 13. On top of the fork pockets 13 are arranged triangular transverse support pieces 73*a*, 73*b* which form upper parts of the transverse supports 7 and which support the trough 8 from below, in which case the fork pockets 13 and said triangular transverse support pieces 73*a*, 73*b* form transverse supports 7. The number of such transverse supports 7 provided with fork pockets 13 is two in the embodiment of FIGS. 1 to 8 (cf. FIG. 3 in particular).

All corners of the bottom structure 10 of the container are provided with fastening members 110 (cf. FIGS. 3 and 1, for instance) for fastening the container to an underlying support base (not shown).

The container is an open-top container so as to enable it to be loaded from above by a crane. Alternatively, the container may comprise a roof structure which, preferably, is openable. Preferably, one end of the container is provided with a loading door (not shown).

Figure 4:
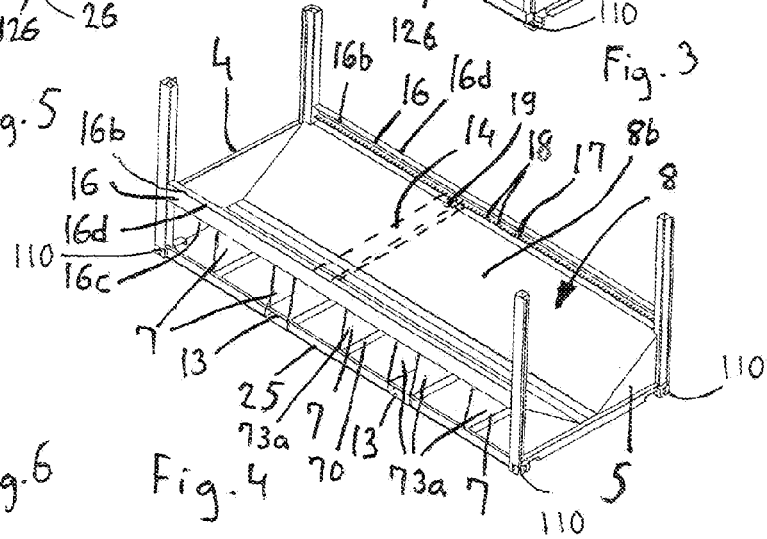
FIG. 4 is an axonometric view illustrating an interior of the cargo transport unit.

FIG. 4 shows the structure of FIG. 3 obliquely from above. A transverse support member 14, drawn in broken line, is provided for supporting a reel (cf. a reel 15 drawn in broken line in FIG. 2) in the longitudinal direction of the container during transport. The support member 14 is arranged against and as close to a side of a reel to be supported as possible. The purpose of the support member 14 is upon a possible collision instance (when a vehicle transporting a cargo transport unit collides with an obstacle) to keep the reel in place in the longitudinal direction of the cargo transport unit, in which case the support member receives an impact/propulsive force caused by the reel upon the collision. Preferably, such a support member 14 is arranged on both sides of the reel (as close to the side of the reel as possible). In FIG. 4, reference number 16 denotes a profile piece arranged above the trough 8 for receiving an end of the support member 14. The profile piece 16 is provided with a rail 17 attached thereto and comprising a plurality of fastening means 18 for receiving fastening members 19 provided at the ends of the support member 14. When the fastening member 19 of the support member 14 is arranged to cooperate with the fastening means 18 of the rail 17, the support member 14 becomes detachably locked to the profile piece 16 (via the rail 17), whereby the support member 14 is prevented from moving in the longitudinal direction of the profile piece 16 and the container. Both sides of the container are provided with a similar profile piece, rail, fastening means and fastening member. In deviation from the embodiment of FIG. 4, it is feasible that the support member 14 becomes detachably locked to the profile piece 16 with no rail 17 attached to the profile piece 16 being used for the locking, in which case the locking is arranged in another manner, for instance directly to fastening means which are provided in the profile piece and which may be holes, for instance. The fastening member 19 and the fastening means 18 enable the support member 14 to be locked at a desired point in the longitudinal direction of the container. When the fastening member 19 is detached from the fastening means, the support member 14 may be moved to a desired point in the longitudinal direction of the container. The fastening member 19 may preferably be a pin, in which case the fastening means 19 may preferably be formed of a number of recesses which are provided in the rail 17 and may comprise bottoms or be bottomless, in which case they are holes. In practice, a plurality of support members 14 is provided, whereby they preferably are further formed to withstand vertical load in order to carry cargo placed thereon. In such a case, the container is suitable for transporting both cylindrical cargo and other cargo. The rails 17 and the trough 8 have to be made extremely strong in order for them to withstand the load caused by the cargo, which may be even more than 100 t when the cargo consists of heavy steel reels. If a heavily loaded cargo transport unit is, during operation, subjected to longitudinal acceleration forces, for example in connection with a collision (if the cargo transport unit is transported by land), the rails 17 and the fastening points of the rails are correspondingly subjected to great acceleration forces.

FIG. 5 illustrates a section along line V-V of FIG. 1. FIG. 5 shows that the rails 17 are, in their entirety, positioned farther from a longitudinal symmetry plane S-S of the container than a closest distance L2 of the vertical side walls arranged on the container sides 2, 3 from the longitudinal symmetry plane S-S of the container, whereby a closest distance L1 of an edge 24 of the rails 17 closest to the longitudinal symmetry plane S-S of the container from the longitudinal symmetry plane S-S of the container is substantially longer than the closest distance L2 of the vertical side walls of the container, which are positioned above the rails, from the longitudinal symmetry plane S-S of the container. Alternatively, the rails 17 may only for the most part, i.e. not in their entirety, be positioned farther from the longitudinal symmetry plane S-S of the container than the closest distance L2 of the side walls from the longitudinal symmetry plane S-S of the container. In such a case, the closest distance L1 of the edge 24 of the rails 17 closest to the longitudinal symmetry plane S-S of the container from the longitudinal symmetry plane S-S of the container is approximately (substantially) the same as the closest distance L2 of the side walls of the container, which are positioned above the rails, from the longitudinal symmetry plane S-S of the container, i.e. L1 may be slightly longer or, alternatively, slightly shorter than L2.

Figure 6:
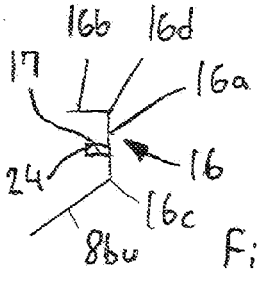
FIG. 6 shows an inclined upper part of a support wall of a trough of the cargo transport unit of FIGS. 1 to 5 when viewed in a longitudinal direction of the trough, and a profile piece arranged above the trough and having a rail being fastened thereto.

The purpose of FIG. 6 is to show that the profile piece 16 above the trough comprises a vertical wall 16*a* connected to an inclined upper part 8*bu* of the support wall of the trough via a bend 16*c*. The profile piece 16 further comprises a horizontal portion 16*b* connected to an upper end of the vertical wall 16*a* of the profile piece via a bend 16*d*. Said bends 16*c* and 16*d* are also denoted in FIGS. 1, 3, and 4. Edging a planar plate twice provides a profile piece 16 above the trough 8 and, at the same time, an inclined upper part 8*bu* of the inclined support wall 8*b* of the trough. Correspondingly, the inclined support wall 8*a* of the trough 8 comprises an inclined upper part 8*au*, cf. FIG. 9. FIG. 9 also shows inclined lower parts 8*al*, 8*bl* of the support walls 8*a*, 8*b* of the trough 8 and a bottom part 8*c* of the trough. The profile piece 16 is easy to manufacture in the described manner. The vertical wall 16*a* of the profile piece 16 may be connected via more than one bend (cf. the bend 16*c* in FIG. 6) to the inclined upper part 8*bu* of the trough (cf. the inclined upper part 8*bu* in FIG. 6).

FIG. 7 shows the container from below while FIG. 8 illustrates a section along line VIII-VIII of FIG. 7.

FIGS. 9 to 11 are front, side, and top views showing a transverse support 7 of the container. The trough 8 settling on top of the transverse support 7 and the longitudinal edge profiles 25, 26 of the bottom structure of the container settling at ends 71*a*, 71*b* of the transverse support are drawn in broken line. The ends 71*a*, 71*b* of the lower parts 70 of the transverse supports 7 are welded 76*a*, 76*b* to the edge profiles 25, 26. The lower part 70 of the transverse support 7 comprises a horizontal lower plane 72 which is perpendicular to a vertical upper plane 74 defined by an upper part 73*a*, 73*b* of the transverse support. Between the lower plane 72 and the upper plane 74 is provided a bend 75. The lower part 70 of the transverse support 7 is formed of a profile piece, preferably of a U profile (U beam), as shown in FIGS. 9 and 10, and the upper part 73*a*, 73*b* is formed by cutting sheet material and preferably further by edging, in which case it is, according to FIGS. 9 and 10, provided with a horizontal plane 101*a*, 101*b* and great stiffness. The upper part 73*a*, 73*b* of the transverse support 7 settles on top of a horizontal upper plane 102 of the lower part 70 and is welded to the horizontal upper plane 102 of the lower part 70.

FIGS. 12 to 14 illustrate a second embodiment of the invention by showing a transverse support alternative to the solution shown in FIGS. 9 to 11. In the figures, like reference marks identify the same elements as in FIGS. 9 to 11. The transverse support 7' of FIGS. 12 to 14 differs from the transverse support of FIGS. 9 to 11 such that the lower part 70' and the upper part 73' of the transverse support 7' are in one piece produced by edging sheet material. Thus, the lower part 70' of the transverse support 7' is not a separate profile piece connected to the upper part 73' of the transverse support, but a transition point of the lower part 70' and the upper part 73' has no joint nor seam. The structure of the transverse support 7' of FIGS. 12 to 14 is simpler than that of the transverse support 7 of FIGS. 9 to 12. However, the structure of the transverse support 7 of FIGS. 9 to 11 is stiffer and stronger than that of the transverse support of FIGS. 12 to 14, if the wall thickness of the transverse supports 7, 7' is the same.

The embodiment of FIGS. 12 to 14 differs from the embodiment of FIGS. 9 to 11 also such that the longitudinal supports of the frame structure supporting the trough from below are straight planar plate pieces, cf. supports designated by reference number 130', which reside substantially perpendicular to the support walls 8*a*', 8*b*' of the trough 8'. In the embodiment of FIGS. 12 to 14, instead of plate pieces, the supports 130' may naturally be profile pieces whose cross section follows the shape of V, as in the embodiment of FIGS. 9 to 11, or their cross section may follow the shape of U.

FIG. 15 shows an inclined upper part 8*bu*' of a support wall of a trough of the second embodiment of the invention and a profile piece 16' which is arranged thereabove and whose structure is similar to the structure of the first embodiment shown in FIG. 6.

In the following, a list is given to show the meaning of the reference numbers used in the application:

1 frame structure supporting trough 8 from below
2 first side
3 second side
4 first end
5 second end
7, 7' transverse support of frame structure 1
8, 8' trough
8*a*, 8*b*, 8*a*', 8*b*' inclined support wall of trough 8, 8'
8*al*, 8*al*' inclined lower part of support wall 8*a*, 8*a*' of trough 8, 8'
8*au*, 8*au*' inclined upper part of support wall 8*a*, 8*a*' of trough 8, 8'
8*bu*, 8*bu*' inclined upper part of support wall 8*b*, 8*b*' of trough 8, 8'
8*c*, 8*c*' bottom part of trough 8, 8'
10 bottom structure
13 fork pocket
14 transverse support member
15 cargo

16, 16' profile piece
16*a*, 16*a'* vertical wall of profile piece 16, 16'
16*b*, 16*b'* horizontal portion of profile piece 16, 16'
16*c*, 16*c'* bend
17, 17' rail
18 fastening means
19 fastening member
24, 24' edge
25, 25' first transverse edge profile of bottom structure 10
26, 26' second transverse edge profile of bottom structure 10
30, 30' weld
70, 70' lower part of transverse support 7, 7'
71*a*, 71*a'* first end of lower part 70, 70'
71*b*, 71*b'* second end of lower part 70, 70'
72, 72' lower plane of lower part 70, 70' of transverse support 7, 7'
72*a*, 72*b*, 72*a'*, 72*b'* weld
73*a*, 73*b*, 73' upper part of transverse support 7, 7'
73*b*, 73' upper part of transverse support 7, 7'
74, 74' vertical upper plane defined by upper part 73*a*, 73*b*, 73' of transverse support 7, 7'
75, 75' bend between lower plane 72, 72' and upper plane 74, 74'
76*a*, 76*b*, 76*a'*, 76*b'* weld
101*a*, 101*b* horizontal plane of transverse support 7
102 horizontal upper plane of lower part 70
103*a*, 103*b*, 103*a'*, 103*b'* inclined upper edge of transverse support 7, 7'
110, 110' fastening members
125, 126, 125', 126' lower surface of edge profile 25, 26, 25', 26'
130, 130' longitudinal support of frame structure 1
L1 closest distance of edge 24 of rail 17 closest to longitudinal symmetry plane S-S of cargo transport unit from longitudinal symmetry plane S-S of cargo transport unit
L2 closest distance of vertical side walls arranged on cargo transport unit sides 2, 3 from longitudinal symmetry plane S-S of cargo transport unit
S-S longitudinal vertical symmetry plane of cargo transport unit.

In the above, the invention is described by means of an example, wherefore it is noted that the details of the invention may be implemented in many different ways within the scope of the attached claims. Consequently, the detailed shaping of the transverse supports and the shape of the edge profiles may differ from the disclosed one and the shape of the edge profiles may differ from the disclosed U shape; the latter ones may be profiles having the shape of L or that of a rectangle, for instance. The cargo transport unit does not have to be a container; it may be without a roof structure or even without actual side walls, in which case it may be called a cargo transport cassette. The cargo transport unit does not have to be of the type comprising profile pieces or rails arranged above the trough for receiving transverse support members in order to enable the cargo to be supported in the longitudinal direction of the cargo transport unit.

The invention claimed is:

1. A cargo transport unit for transporting cylindrical cargo, the cargo transport unit comprising a first side extending in a longitudinal direction of the cargo transport unit and a second side opposite the first side, a first end transverse to the longitudinal direction of the cargo transport unit and a second end opposite the first end, a trough extending in the longitudinal direction of the cargo transport unit and comprising inclined support walls for supporting the cylindrical cargo on inclined upper surfaces thereof, a frame structure supporting the trough from below and comprising a plurality of transverse supports supporting the inclined support walls of the trough from below and spaced apart from one another in the longitudinal direction of the cargo transport unit, inclined upper edges of the transverse supports being shaped to conform with the inclined support walls of the trough for supporting the inclined support walls over at least a vast majority of their length in a transverse direction of the cargo transport unit, and a bottom structure comprising a first longitudinal edge profile extending in the longitudinal direction of the cargo transport unit and a second longitudinal edge profile positioned oppositely to the first longitudinal edge profile, wherein the first longitudinal edge profile and the second longitudinal edge profile are both made of a profile comprising a continuous seamless structure extending from the first end of the cargo transport unit to the second end thereof, and the transverse supports comprise a lower part extending from the first longitudinal edge profile to the second longitudinal edge profile and residing at a height level of the longitudinal edge profiles, a first weld connecting a first end of the lower part to the first longitudinal edge profile and a second weld connecting a second end of the lower part to the second longitudinal edge profile.

2. The cargo transport unit as claimed in claim 1, wherein the longitudinal edge profiles are U-shaped profiles.

3. The cargo transport unit as claimed in claim 1, wherein the frame structure supporting the trough from below comprises longitudinal supports for preventing the trough from buckling, the longitudinal supports extending in the longitudinal direction of the cargo transport unit arranged between the transverse supports and welded to a lower surface opposite the inclined upper surface of the inclined support walls of the trough.

4. The cargo transport unit as claimed in claim 3, wherein a cross section of the longitudinal supports follows the shape of V.

5. The cargo transport unit as claimed in claim 3, wherein the cross section of the longitudinal supports follows the shape of U.

6. The cargo transport unit as claimed in claim 3, wherein the longitudinal supports are straight planar plate pieces residing substantially perpendicular to the inclined support walls of the trough.

7. The cargo transport unit as claimed in claim 1, wherein the transverse supports are sheet material, and the lower part of the transverse supports comprises a horizontal lower plane which is perpendicular to a vertical upper plane defined by an upper part of the transverse supports, whereby a bend is provided between the lower plane and the upper plane.

8. The cargo transport unit as claimed in claim 7, wherein the lower part of the transverse support is a profile piece, and the upper part of the transverse support comprises at least one planar piece, a weld connecting said profile piece to said at least one planar piece.

9. The cargo transport unit according to claim 7, wherein the lower part and the upper part of the transverse support are sheet material and in one piece a bend being provided between the lower part and the upper part.

10. The cargo transport unit as claimed in claim 7, wherein the lower plane of the lower part of the transverse supports resides at substantially the same height as a plane defined by lower surfaces of the longitudinal edge profiles.

11. The cargo transport unit according to claim 10, wherein corners of the bottom structure of the cargo transport unit are provided with fastening members for fastening the cargo transport unit like a container to an underlying support base, whereby the lower plane of the lower part of the transverse supports resides above a plane defined by lower ends of the fastening members provided in the corners of the bottom structure of the cargo transport unit.

12. The cargo transport unit as claimed in claim 1, further comprises a profile piece connected to both of the opposite sides of the cargo transport unit, said profile piece being arranged above the trough and extending in the longitudinal direction of the cargo transport unit for receiving at least one support member transverse to the longitudinal direction of the cargo transport unit, the support member being provided for supporting cylindrical cargo in the longitudinal direction of the cargo transport unit, the profile pieces comprising fastening means for locking the transverse support member detachably to a desired point in the profile pieces in the longitudinal direction of the profile pieces by means of fastening members at opposite ends of the transverse support member, whereby, when the fastening members of the transverse support member are in a locking position and arranged to cooperate with the fastening members of the profile pieces, the transverse support member is prevented from moving in the longitudinal direction of the profile piece and the cargo transport unit, whereby the profile pieces arranged above the trough are formed in one piece together with inclined upper parts of the support walls of the trough by bending sheet material, whereby the profile pieces comprise a vertical wall connected to the inclined upper parts of the support walls of the trough via at least one bend provided in the longitudinal direction of the cargo transport unit.

13. The cargo transport unit as claimed in claim 12, wherein the profile piece above the trough comprises a horizontal portion connected to an upper end of the vertical wall of the profile piece via a bend.

14. The cargo transport unit as claimed in claim 12, wherein the fastening means of the profile piece are formed in a rail provided in the longitudinal direction of the cargo transport unit and fastened to the vertical wall of the profile piece located above the trough.

15. The cargo transport unit as claimed in claim 14, wherein the rails arranged in the opposite profile pieces of the cargo transport unit are, at least for the most part, positioned farther from a longitudinal symmetry plane of the cargo transport unit than a closest distance of the side walls arranged on the sides of the cargo transport unit from the longitudinal symmetry plane of the cargo transport unit, and a closest distance of an edge of the rails closest to the longitudinal symmetry plane of the cargo transport unit from the longitudinal symmetry plane of the cargo transport unit is substantially the same or longer than the closest distance of the vertical side walls of the cargo transport unit above the rails from the longitudinal symmetry plane of the cargo transport unit.

* * * * *